United States Patent [19]

McLeod

[11] Patent Number: 4,657,075

[45] Date of Patent: Apr. 14, 1987

[54] WELL HEAD ISOLATION TOOL

[76] Inventor: Roderick D. McLeod, 5104 125th St., Edmonton, Alberta, Canada, T6H 3V5

[21] Appl. No.: 813,790

[22] Filed: Dec. 27, 1985

[30] Foreign Application Priority Data

Mar. 22, 1985 [CA] Canada ..... 477205

[51] Int. Cl.[4] ..... E21B 33/02; E21B 23/06

[52] U.S. Cl. ..... 166/72; 166/82; 166/196

[58] Field of Search ..... 166/72, 179, 77, 77.5, 166/82, 84, 176, 196; 285/138–140

[56] References Cited

U.S. PATENT DOCUMENTS

| | | | |
|---|---|---|---|
| 1,997,431 | 4/1935 | Penick et al. | 166/82 |
| 2,449,642 | 9/1948 | Coons | 166/20 |
| 2,555,145 | 5/1951 | McKinney | 166/77 |
| 2,813,589 | 11/1957 | Woodruff | 166/225 |
| 2,935,133 | 5/1960 | Eckel et al. | 166/188 |
| 2,954,742 | 10/1960 | Williams | 285/139 |
| 3,100,536 | 8/1963 | Tamplen . | |
| 3,392,785 | 7/1968 | King | 166/196 |
| 4,241,786 | 12/1980 | Bullen | 166/77 |

FOREIGN PATENT DOCUMENTS

| | | | |
|---|---|---|---|
| 1020089 | 11/1977 | Canada | 166/67 |

*Primary Examiner*—Stephen J. Novosad
*Assistant Examiner*—Bruce M. Kisliuk
*Attorney, Agent, or Firm*—Hubbard, Thurman, Turner & Tucker

[57] ABSTRACT

A concentric mandrel assembly for use in a wellhead isolation tool is operable from outside the wellhead and casing. An outer mandrel of the assembly carries a packoff nipple, including a resilient seal member, on its lower end and the inner mandrel of the assembly carrier carries an expander on its lower end. Means are provided for axially moving the mandrels relative to one another so that the expander can apply outward force on the resilient seal against the wall of a well casing.

1 Claim, 5 Drawing Figures

WELL HEAD ISOLATION TOOL

FIELD OF THE INVENTION

This invention relates to wellhead isolation tools and in particular to a concentric mandrel assembly and expandable packoff nipple for use therewith.

BACKGROUND OF THE INVENTION

When an oil or gas well is being serviced a device referred to in the trade as a "tree saver" or wellhead isolation tool is often used. These tools utilize a packoff nipple of a size to fit the tubing or well casing. Typically, the nipple is cylindrical in shape as is the well casing that they seal in. The outer surface of the nipple has a rubber sleeve bonded to a steel surface of the nipple with the outside diameter of the rubber sleeve being somewhat larger than the inside diameter of the well casing in which the nipple is installed so that when the nipple is first inserted by the tool, a slight seal is effected. Subsequently, when fluid or gas is pumped through the tool at high pressure, this pressure is applied outwardly against the skirt of the rubber sleeve to force it against the wall of the well casing. An improved type of nipple is shown in my Canadian Pat. No. 1,169,766 issued June 26, 1984. The nipple of the abovementioned Canadian patent is inserted by a wellhead isolation tool with an insertion drive system of the type illustrated in my copending Canadian application Ser. No. 444,889 filed Jan. 9, 1984. As mentioned above, the packoff nipples are made slightly oversize in relation to the inside diameter of the well casing in which they are to seal. The packoff nipple is then forced through the wellhead valves and fittings and landed in place in the casing. While wellhead valves and fittings have tightly controlled inside diameters, wellhead casings do not. Accordingly it can happen that a packoff nipple that will fit through the wellhead assembly will be of insufficient diameter to seal tightly against the inner wall of the well casing after it has landed. Conversely, some packoff nipples will fit very tightly into the well casing and may even be damaged by being forced in. This is due to the fact that in many instances, well casing is not perfectly round or it may be corroded or washed due to well fluid properties and characteristics and it therefore becomes difficult to obtain a good seal with a standard size nipple.

The present invention provides a concentric mandrel assembly for use with the wellhead isolation tool and includes an outer mandrel of the assembly carrying a packoff nipple, including a resilient seal member, on its lower end and an inner mandrel of the assembly carrying an expander on its lower end. Means are provided for axially moving the mandrels relative to one another so that the expander can apply outward force on the resilient seal against the inner wall of a well casing. The mandrels can be locked in relation to each other to hold the nipple in the expanded position and the nipple can be subsequently released when it is required to pull it out of the well casing. The mandrel assembly is actuated from outside the wellhead and well casing, and independent of the conditions inside the well. Due to the use of an expandable member, a much more effective seal can be applied against the inside wall of the casing and a casing that is slightly off round or has surface imperfections, can be accommodated.

SUMMARY OF THE INVENTION

According to a broad aspect, the invention relates to a concentric mandrel apparatus for use in a wellhead isolation tool. The apparatus comprises means for mounting the apparatus on a wellhead; spaced, upper and lower beam assemblies, the lower beam assembly being secured to the mounting means; and an intermediate beam assembly adjustably connected to the upper beam assembly. An outer mandrel is connected to the intermediate beam and nipple means including a resilient sealing member are attached to the lower end of the outer mandrel. An inner mandrel is concentrically located within the outer mandrel and is secured to the upper beam assembly and a seal expander is provided on the lower end of the inner mandrel. Means for moving the upper and intermediate beam assemblies with respect to the lower beam assembly is provided so as to lower or raise the concentric mandrels in a well casing; and means are provided for moving the upper beam assembly with respect to the intermediate beam assembly so as to move the inner mandrel with its expander with respect to the outer mandrel and its sealing member. Thus, the expander engages and deforms the sealing member to expand it outwardly against the wall of the casing.

BRIEF DESCRIPTION OF THE DRAWINGS

The invention is illustrated by way of example in the accompanying drawings in which.

DETAILED DESCRIPTION

Figure 1:
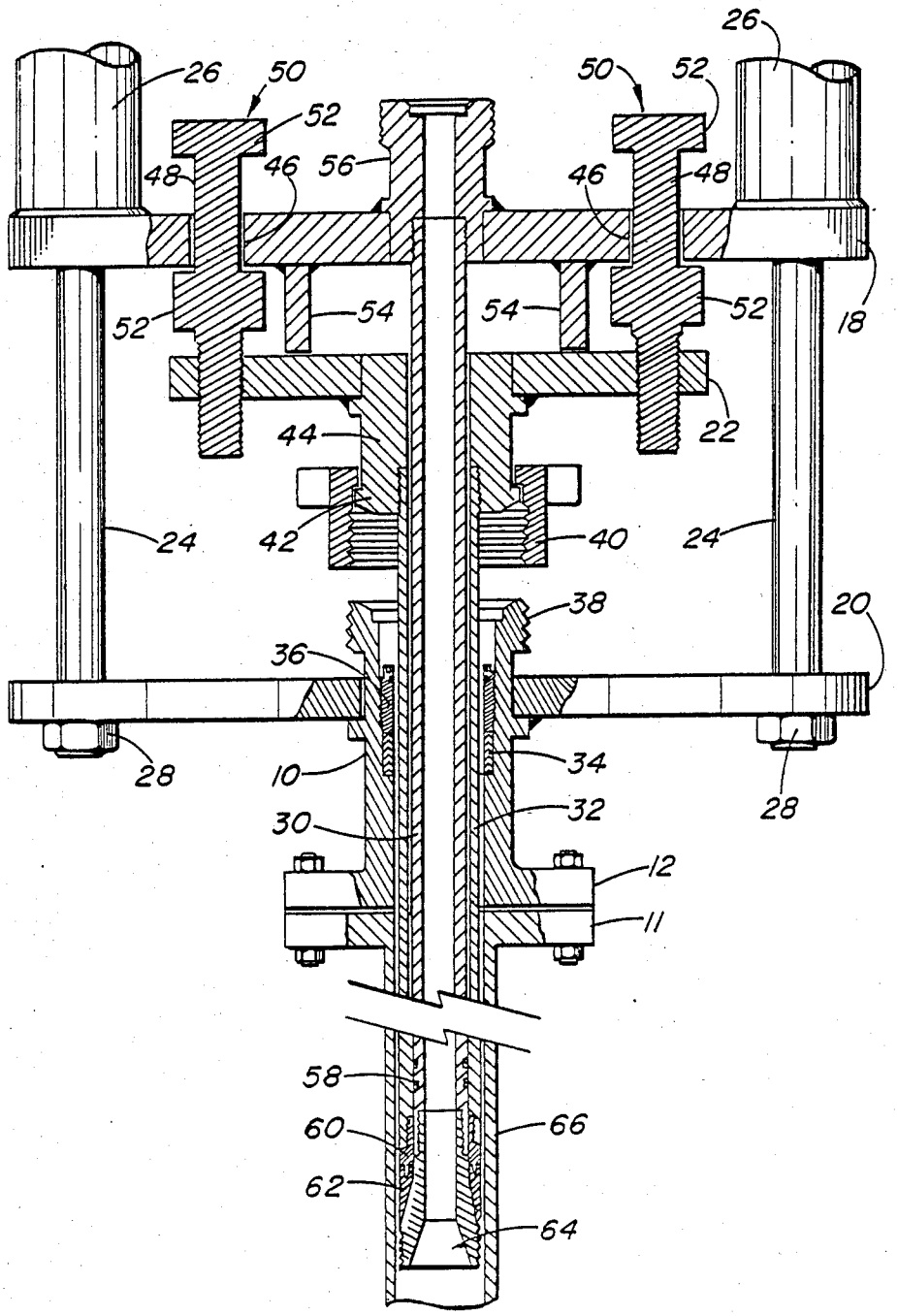
FIG. 1 is an elevation view, partly in section, of the concentric mandrel apparatus.
Figure 2:
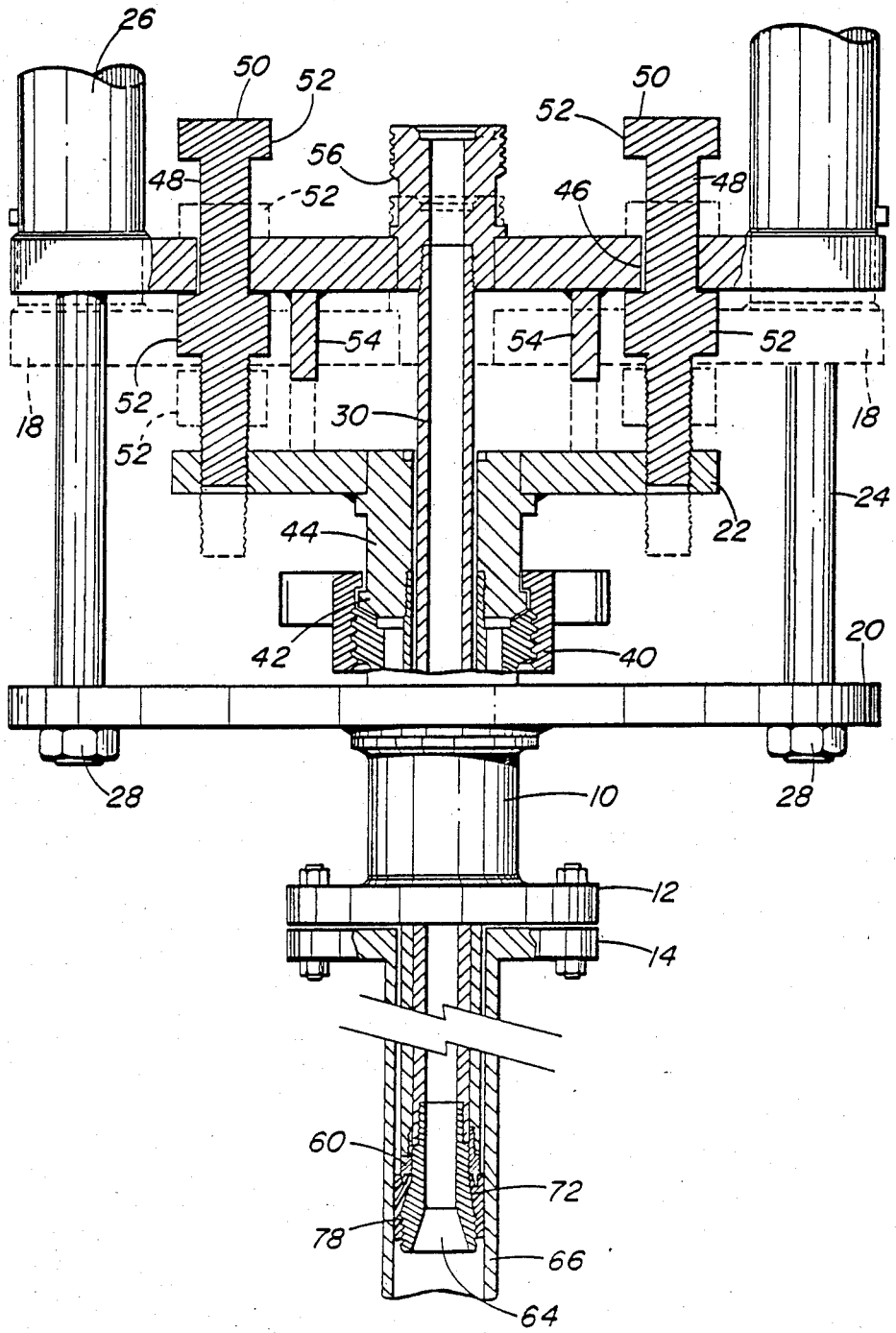
FIG. 2 is a view similar to FIG. 1 but showing the apparatus in another operative position.

It is acknowledged that many different nipple shapes may be used with the present invention and that numerous ways of moving the inner mandrel with respect to the outer mandrel may be devised together with various methods of locking the mandrel in place. The illustrations of FIGS. 1 and 2 are therefore by way of example and referring to FIG. 1, the apparatus includes a lower body 10 having a flanged end 12 for attachment to a similarly flanged end 14 of a wellhead assembly 16. This connection may be flanged, threaded or clamped in accordance with the user's requirements. The wellhead assembly 16 may include a master valve body, not shown.

The apparatus includes an upper beam assembly 18, a lower beam assembly 20 and an intermediate beam assembly 22. The lower beam assembly 20 is secured by welding to the lower body 10 as illustrated and is interconnected to the upper beam assembly through rods 24 of actuating cylinders 26 secured to the upper beam assembly 18. As shown, the terminal ends of the rods 24 are secured to the lower beam assembly by nuts 28 or other suitable means.

The lower body 10 includes a central passageway for the movement therethrough of the inner and outer mandrels 30, 32 and it further includes a packing set 34 and gland 36. The upper terminal end of the body 10 is provided with a threaded neck 38 for receiving a hammer nut 40 rotatably carried on the peripheral shoulder 42 of the intermediate body 44 which forms the central part of the intermediate beam assembly 22.

The upper beam assembly 18 is provided with apertures 46 for slidably receiving the body portions 48 of a pair of locking spacers 50. These spacers have shoulder stops 52 of substantial thickness, the lower ends of the locking spacers 50 being threadably engaged in the intermediate beam assembly 22. A pair of stopping blocks 54 limit the upward movement of the intermediate beam assembly 22 with respect to the upper beam assembly 18.

As seen in FIG. 1, the inner mandrel 30 is threadably engaged in and carried by an upper, central body 56 secured to the upper beam assembly 18. The outer mandrel 32 is threadably engaged in and carried by the intermediate body 44 in the intermediate beam assembly 22 and suitable seals 58 are provided adjacent the lower end of the inner mandrel 30 between its outer wall and the inner wall of the outer mandrel 32.

The lower end of the outer mandrel 32 is provided with a steel nipple 60 and it carries a resilient sealing member 62 of any suitable material, preferably moulded rubber.

The lower end of the inner mandrel 30 is provided with a steel expander 64 concentrically located within the nipple 60 and seal 62 of the outer mandrel 32.

Figure 5:
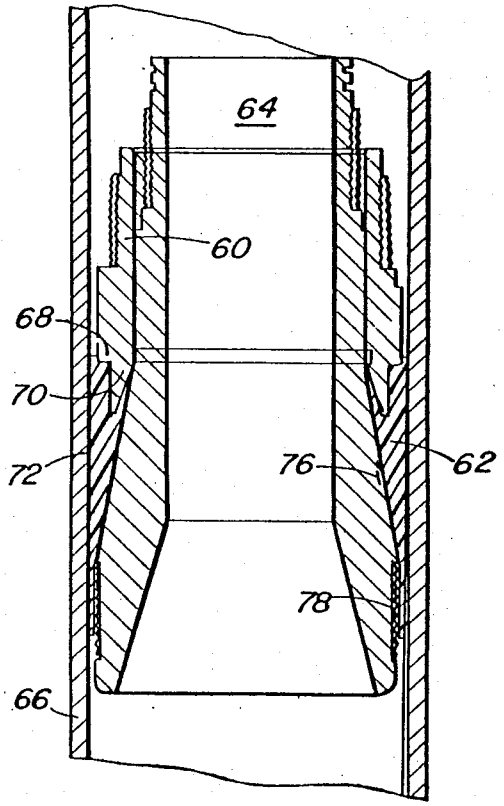
FIGS. 3, 4 and 5 are cross-sectional views of a section of well casing showing the several stages of the expansion of a seal through operation of the concentric mandrel apparatus.
Figure 4:
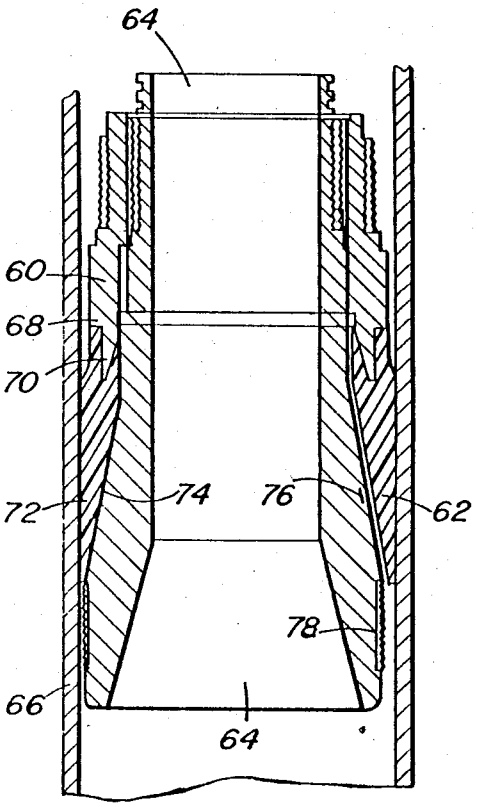
Figure 3:
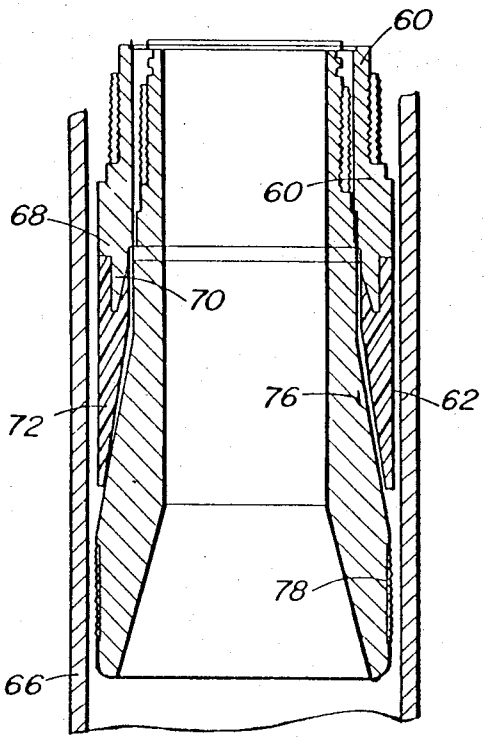

It will be appreciated from FIG. 2 as well as from FIGS. 3, 4 and 5 that securing the outer mandrel 32 in place and then upwardly moving the inner mandrel 30 will cause the expander 64 to outwardly deform the seal 32 on the lower end of the steel nipple 60 and to press the seal against the inner walls of the well casing 66.

The operative position of the various beam assemblies is shown in FIG. 2.

Actuation of the cylinders 26 by means of a known hydraulic system, draws the upper beam assembly 18 towards the lower beam assembly 20, thus forcing the assembly of the upper beam including the upper body 56, stops 54, locking spacers 48, intermediate beam 22 and its associated body 44 and hammer nut 40, together with the outer mandrel 32 and inner mandrel 30 into the wellhead 10 through the lower beam assembly 20. The actuation of the cylinders 26 proceeds until the hammer nut 40 can be locked tightly on the threaded portion of the lower body 10. As shown in FIG. 2, the hammer nut 40 has been tightened and the upper beam assembly 18 and its associated mechanism would be in the position indicated by phantom line. The position of the expander 64 on the lower end of the inner mandrel is also indicated in phantom line in FIG. 2 and in full line in FIG. 3.

As mentioned earlier, various nipple and sealing member configurations are available and can be used successfully with the present invention. As an example, the nipple 60 shown in FIG. 3 has an outer, lower shoulder 68 adjacent an inset flange 70 onto which the upper end of the sealing member 62 is moulded. The sealing member 62 has a depending skirt having a generally cylindrical outer sidewall and a tapered inner sidewall 74 of frustoconical configuration in cross-section.

The expander 64 which is secured to the lower end of the inner mandrel (the mandrels being omitted for clarity in FIGS. 3–5) has a frustoconical outer sidewall portion 76 adjacent a generally cylindrical lower end 78.

With the inner and outer mandrels 30, 32 in the position of FIG. 2 and the associated nipple 60 and expander 64 being in the position of FIG. 3, the actuation of the cylinders 26 is now reversed so that the upper beam 18 and its associated assembly moves upwards, pulling the inner mandrel 30 upwardly through the outer mandrel 32 which is locked in position by the action of the hammer nut 40. This action forces the expander 64 upwardly as shown in FIGS. 4 and 5 so that its frustoconical shoulder 76 engages the inner wall of the sealing element 32 and, under very high pressure, spans the sealing element to the point of deformation as shown in FIG. 5 where the skirt portion of the sealing element extends downwardly between the cylindrical outer wall of the expander 64 and the inner wall of the casing 66.

With the inner and outer mandrel in the positions where the expander 64 is drawn up tightly within the nipple 60, an effective seal is provided between the interior of the casing 66 below the nipple 60 and its sealing element 62, and the upper body 56 carried by the upper beam assembly 18. Accordingly, any fluids or substances passing through the upper body 56 and the inner mandrel 30 will not affect anything in the wellhead assembly above the nipple 60 and its associated sealing member 62. Thus, the wellhead is isolated from any action of materials or pressure in the upper body 56 and the inner mandrel 30.

In order to keep the inner mandrel 30 and its expander 64 locked in place with respect to the outer mandrel 32 and its nipple 60 and sealing element 62, the locking spacers 50 are backed up as shown in FIG. 2 until the lower shoulders 52 engage the underside of the upper beam assembly 18 where they are in a position to hold the upper beam 18 at the illustrated point or at any distance from the intermediate beam 22 which carries the outer mandrel 32. As a result, there can then be no downward movement of the inner mandrel 30 with relation to the outer mandrel 32 and its assembly. Any upper movement will help to increase the sealing effort in the casing 66.

The hydraulic pressure in the actuating cylinders can then be released and the system is ready for use.

To release the unit from the wellhead, the hydraulic cylinders are actuated in such a way as to take the locking force off the locking spacers 50 which are then screwed into the intermediate beam 22 and the actuation of the cylinders 26 is then reversed to force the inner mandrel 30 and its expander 64 out of the sealing element 62 and the nipple 60. This frees the tool from any contact with the casing 66 and it can now be withdrawn by actuation of the hydraulic cylinders 26 after the hammer nut 40 has been loosened.

Those skilled in the art will appreciate that various features, characteristics and advantages of the present invention have been set forth herein or are readily realizable from the detailed description of the preferred embodiment. However, the disclosure is illustrative and various changes may be made while utilizing the principles of the present invention and following within the scope of the invention as expressed in the appended claim.

The embodiments of the invention in which an exclusive property or privilege is claimed are defined as follows:

1. A concentric mandrel apparatus for use in a wellhead isolation tool, said apparatus comprising:

(a) means for mounting said apparatus on a wellhead;

(b) spaced, upper and lower beam assemblies, said lower beam assembly being secured to said mounting means;

(c) an intermediate beam assembly adjustably connected to said upper beam assembly;

(d) an outer mandrel connected to said intermediate beam and nipple means including a resilient sealing member attached to the lower end thereof;

(e) an inner mandrel concentrically located within said outer mandrel and secured to said upper beam assembly, and a seal expander on the lower end of said inner mandrel;

(f) means for moving the upper and intermediate beam assemblies with respect to the lower beam assembly so as to lower or raise said concentric mandrels in a well casing; and (g) means for moving the upper beam assembly with respect to the intermediate beam assembly so as to move the inner mandrel with its expander with respect to the outer mandrel and its sealing member so that said expander engages and deforms said sealing member to expand it outwardly against the wall of said casing.

* * * * *